US005747431A

United States Patent [19]

Taylour et al.

[11] Patent Number: 5,747,431

[45] Date of Patent: May 5, 1998

[54] LUBRICANT COMPOSITIONS

[75] Inventors: James Taylour, Warrington, England; Eberhard Glozbach, Werz, Germany

[73] Assignee: Diversey Lever Inc., Plymouth, Mich.

[21] Appl. No.: 682,751

[22] PCT Filed: Jan. 12, 1995

[86] PCT No.: PCT/CA95/00024

§ 371 Date: Feb. 3, 1997

§ 102(e) Date: Feb. 3, 1997

[87] PCT Pub. No.: WO95/19412

PCT Pub. Date: Jul. 20, 1995

[30] Foreign Application Priority Data

Jan. 12, 1994 [GB] United Kingdom ..... 9400436

[51] Int. Cl.[6] ..... C10M 173/02

[52] U.S. Cl. ..... 508/283; 508/285

[58] Field of Search ..... 508/283, 285

[56] References Cited

U.S. PATENT DOCUMENTS

| | | | |
|---|---|---|---|
| 2,267,965 | 12/1941 | Wilson | 508/283 |
| 3,390,081 | 6/1968 | Floeck | 508/285 |
| 3,390,085 | 6/1968 | Floeck | 508/283 |
| 3,574,100 | 4/1971 | Wetmore | 252/32.5 |
| 3,788,989 | 1/1974 | Adams et al. | 508/283 |
| 3,827,874 | 8/1974 | Adams | 71/67 |
| 4,128,655 | 12/1978 | Hunsucker et al. | 424/273 R |
| 5,599,779 | 2/1997 | Karol et al. | 508/283 |

FOREIGN PATENT DOCUMENTS

| | | |
|---|---|---|
| 2131312 | 2/1993 | Canada . |
| 2131388 | 2/1993 | Canada . |
| 834578 | 7/1955 | United Kingdom . |
| WO9318120 | 9/1993 | WIPO . |

OTHER PUBLICATIONS

Abstract, JP1096294, Japanese patent *Sterilising Lubricant for Conveyor Belt*Apr. 14, 1989.

*Primary Examiner*—Jacqueline V. Howard
*Attorney, Agent, or Firm*—Milton L. Honig

[57] ABSTRACT

A lubricant composition having biocidal properties comprises a cyclic imidazoline as the active lubricant in combination with sufficient acid to render the imidazoline soluble in water and optionally including amides and nonionic surfactants. The concentrate, when diluted for use, provides biocidal control action against yeasts and bacteria. The concentrate is preferably adjusted to a pH in the range of 3 to 8.3.

19 Claims, No Drawings

LUBRICANT COMPOSITIONS

FIELD OF THE INVENTION

The present invention relates to lubricant compositions, and more -specifically to lubricant compositions for use in lubricating the tracks which convey bottles, cans and similar containers and packages for beverages and other foodstuffs from one station to another in a packaging plant.

BACKGROUND OF THE INVENTION

Beverages are sold in a variety of containers such as glass bottles, plastics bottles, plastic containers, cans, or waxed carton packs. These containers are conveyed through a number of stations in a plant where they are filled with the desired beverage; the containers are conveyed from one station to another by a track which is usually of stainless steel when the containers are glass bottles, or of a plastics material such as polypropylene or an acetal resin (sold under the trademark Delrin) when the containers are other than glass bottles. Such tracks will hereinafter be referred to as "conveyor track".

When the containers are being filled and transported, blockages occasionally occur preventing the free movement of the containers while the conveyor continues to move. In such instances it is important that the conveyor track is properly lubricated so that the track can continue to move even though the containers on the track are temporarily prevented from advancing.

In order to ensure smooth operation of the filling process, it is imperative to ensure that the conveyor track is properly lubricated and cleaned. If the conveyor track is not properly lubricated, the containers can easily fall over or fail to stop moving when they reach the appropriate station in the plant. This can cause serious disruption to the efficient operation of the filling process.

Lubricant compositions which are currently used for lubricating and cleaning conveyor track are generally of three main types:

(i) compositions based on fatty acids, (ii) compositions based on fatty amines, and (iii) compositions based on phosphate esters.

Aqueous solutions of fatty acids are not suitable for use in areas of hard water, unless they are stabilized by the incorporation of a complexing agent such as ethylenediamine tetra-acetic acid (EDTA).

A problem encountered with the conveyor track is the need to keep the containers as free from microbial contamination as possible. This is especially important where soil spillage occurs, for example spillage of beer, orange juice, cola and other beverages.

We have now produced a new lubricating composition for use in lubricating conveyor track which has the advantage that it has biocidal properties as well as providing the necessary lubrication. Additionally, the biocidal properties do not appear to be detrimentally influenced by typical soil spillage.

SUMMARY OF INVENTION

According to one aspect of the present invention, there is provided a concentrate which, upon dilution with water, forms a lubricant composition for use as a lubricant for conveyor track. The concentrate comprises the following components:

(a) a cyclic imidazoline of the general formula (I)

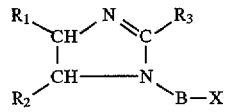

(I)

wherein $R_1$, $R_2$, and $R_3$ are the same or different and are each —H or —A —Y, in which A is a $C_7$ to $C_{20}$ saturated or unsaturated, linear or branched chain alkylene group, B is a $C_1$ to $C_{20}$ saturated or unsaturated, linear or branched chain alkylene group, Y is H, $NH_2$, OH, or $COOM_1$ in which $M_1$ is H or a Group 1 metal ion, and X is H, $NH_2$, OH, $COOM_2$ or —NH—CO—$R_4$, in which $M_2$ is the same or different from $M_1$ and is H or a Group 1 metal ion and $R_4$ is a $C_1$ to $C_{20}$ saturated or unsaturated, linear or branched chain alkyl group; and (b) an amount of acid sufficient to render the cyclic imidazoline soluble in water.

Generally, $R_4$ is a $C_6$ to $C_{20}$ saturated or unsaturated linear or branched chain alkyl group and, preferably, at least one of $R_1$, $R_2$, $R_3$, B and $R_4$ includes a saturated or unsaturated linear alkylene group of at least 12 carbon atoms or a branched chain alkylene group also of at least 12 carbon atoms. This imparts useful lubricant properties to the concentrate. In a preferred embodiment, group A of the cyclic imidazoline has from 12 to 18 carbon atoms, most preferably 17 carbon atoms, so that the lubricity of the lubricant composition is optimized. Preferably, group B has from one to six carbon atoms, most preferably two carbon atoms, also to improve the lubricant properties of the composition. Preferably, X is $NH_2$. More preferably X is $NH_2$, $R_1$ and $R_2$ are H, $R_3$ is AY where A is $C_{17}$ and Y is H.

In another embodiment, the concentrate comprises the following components:

(a) a cyclic imidazoline of the general formula (II):

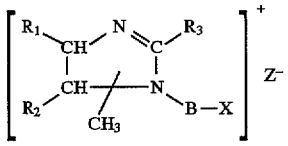

(II)

wherein the moieties $R_1$, $R_2$, $R_3$, B and X are each defined as for the cyclic imidazoline of general formula (I), the $CH_3$ ring substituent is present at position 1 or 3 of the ring, and $Z^-$ is any suitable anion such as $CH_3OSO_3$; and (b) an amount of acid sufficient to render the cyclic imidazoline soluble in water.

In a commercially available form of the cyclic imidazoline of general formula (II), group B has two carbon atoms and X is —NH—CO—$R_4$.

In a further embodiment, the concentrate comprises the following components:

(a) an amide of the general formula (III) or (IV):

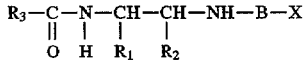

(III)

or

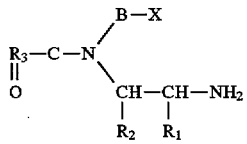

(IV)

wherein the moieties $R_1$, $R_2$, $R_3$, B and X are each defined as for the cyclic imidazoline of general formula (I); and (b) an amount of acid sufficient to render the amide soluble in water.

DETAILED DESCRIPTION OF THE PREFERRED EMBODIMENS

The compounds of general formula (III) or (IV) may be formed as by-products in the manufacture of the cyclic imidazoline (I) or may be formed during storage, dilution or acidification of the cyclic imidazoline (I), for example by hydrolysis. Direct synthesis of the compounds of general formula (III) or (IV) is also envisaged without necessarily forming the compounds via a cyclic imidazoline intermediate.

Component (a) of the concentrate according to the present invention can therefore comprise mixtures of any two or more of the compounds (I), (II), (III) or (IV). A function of the acid in the concentrate is to neutralize and aid solution of component (a) in water. Whilst inorganic acids may be used, the imidazoline salts so formed would be less soluble than the corresponding organic salts. For this reason, organic acids are preferred. However, as the carbon chain length of the acid increases, sensitivity to hard water increases and so acids of chain length up to $C_6$ are preferred. As the carbon chain length increases beyond $C_8$, the acid and hence the formulation becomes unstable in hard water. The typical minimum amount of acid in the concentrate is that which is needed to neutralize component (a) although, in practice, it is preferable to add slightly more than equimolar quantities. Components (a) and (b) of the concentrate may be mixed together in solution or may be supplied together in the form of a salt of component (a) with the acid component (b) present as a suitable counterion, such as an acetate. Further acid or base may then be required to adjust the pH of the concentrate so as to optimize its lubricity in use. The preferred pH range for the concentrate is from 3 to 8, more preferably from 3 to 6.

Optionally, the concentrate further comprises one or more of the following components (c) (i), (ii) or (iii):

(c) (i) A non-ionic surfactant such as an alkoxylated phenol or alkoxylated alcohol in which the carbon chain of the alcohol is saturated or unsaturated, linear or branched.

(ii) An ether carboxylate of general formula (V):

$$R_5—(OC_2H_4)_nOCH_2CCOOH \quad (V)$$

in which $R_5$ is $CH_3—(CH_2)_m^-$, where m is 0 or an integer from 1 to 20, preferably an integer from 2 and 17; or a $C_2$ to $C_{20}$ unsaturated carbon chain; or a saturated or unsaturated branched chain; and n is an integer from 1 to 30, preferably from 2 to 9. Most preferably, $R_5$ is an oleyl group and n=9: this material is available under the trade name Akypo RO 90 from Chemy.

(iii) an alkylamine carboxylate of general formula (VI):

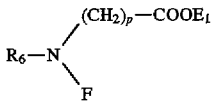

$$R_6—N\begin{matrix}(CH_2)_p—COOE_1\\ F\end{matrix} \quad (VI)$$

in which $R_6$ is a $C_8$ to $C_{20}$ saturated or unsaturated, linear or branched chain alkyl group, $E_1$ is a hydrogen ion or a Group 1 metal ion and F is hydrogen or $—(CH_2)_q—COOE_2$ in which $E_2$ is a hydrogen ion or a Group 1 metal ion and is the same as or different from $E_1$; and p and q are the same or different and are integers from 1 to 12. Preferably $R_6$ is a Coco group ($C_8$ to $C_{18}$ with a preponderance of $C_{10}$, $C_{12}$ and $C_{14}$ chains) and F is $—(CH_2)_q—COOE_2—$ in which p=q=2, $E_1$ is a sodium ion and $E_2$ is a hydrogen ion. This material is available under the trade name Lakeland AMA from Lakeland Laboratories.

In a preferred embodiment, component (c) is the non-ionic surfactant Triton DF 16 available from Union Carbide which is defined by that company as a linear terminated ethoxylate.

The function of component (c) is primarily to reduce foam and to improve the soil handling properties of the final lubricant composition by emulsifying the soil components. If too much foam is produced in the lubricant composition, its ability to lubricate is greatly diminished. A further important function of the component (c) is to aid the solubilization or dissolution of component (a).

In addition to the above components a viscosity controlling agent may optionally be incorporated as a further component of the concentrate. Isopropyl alcohol is a typical viscosity controlling agent. However, glycol ethers, diols and glycols may also be used. The exact quantity would depend upon the desired viscosity of the final product.

Typically, the active amount of component (a) in the concentrate should be in the range 0.5 to 30 weight %, preferably in the range 2 to 20 weight %. On this basis, the active quantity of component (b) in the concentrate would fall within the range 0.05 to 10.5 weight %. if required, additional acid could be added to the concentrate to bring the pH into the required region. Concentrations of the remaining components are not critical.

According to a further aspect of the present invention there is provided a lubricant composition for use as a lubricant for conveyor track. The lubricant composition comprises a concentrate as defined above, diluted in water in the range 0.01 to 80%, preferably 0.05 to 5% (volume/volume). Water used for the dilution may be hard, soft or softened.

The exact dilution of the concentrate depends on factors such as the speed of the conveyor track, the type of package or container being carried by the track, the total loading on the conveyor track and the amount of soiling caused by spillage.

Dilution of the lubricant concentrate is normally performed at a central dispenser, and the diluted lubricant composition is then pumped to spray nozzles at the point of use. There are some areas of the conveyor track that require very little lubricant. Typically these are the zones before the filler and before the pasteurizer. In these regions secondary dilution is often employed. Lubricant is likely to be at its highest use concentration at and after the filler. The lubricant solutions are typically sprayed onto the conveyor from fan jet nozzles placed at the start of each length of track. For particularly long runs, secondary spray jets may be positioned along the length of the track.

In areas of heavy soiling it may be necessary to spray lubricant onto the track continually. However, in most instances timers are employed to vary the dosing rate. Typically, on and off times will be between 10 and 90 seconds. Off times will not always equal on times. Also it is likely that throughout a plant timer settings will vary.

In some applications, a final water wash jet will be placed at the end of a bottle/can filling track. This will wash residues of lubricant from the package before crating and dispatching.

Excess lubricant will be allowed to fall from the track either to the floor or suitable drip trays. In either event it will eventually enter the drainage and water treatment systems.

The present invention is illustrated by the following Examples.

EXAMPLE 1

A concentrate suitable for use upon dilution with water as a conveyor track lubricant was formulated in the following manner from the components set out in the Table below.

TABLE 1

Example Formulation

| Raw Material | % wt/wt Bulk raw material | % wt/wt active raw material |
|---|---|---|
| Soft Water | 77 | 77 |
| Isopropyl Alcohol | 3 | 3 |
| Acetic Acid | 5 | 5 |
| 1-amino ethyl 2 alkyl imidazoline | 12 | 7.8 |
| Alkoxylated nonionic surfactant | 3 | 3 |

A typical manufacturing process for the formulation is as follows:

(1) Charge the vessel with soft water.
(2) Add isopropyl alcohol to the vessel and stir to disperse.
(3) Add acetic acid to the vessel and stir to disperse.
(4) Add the imidazoline and stir to dissolve.
(5) Add the nonionic surfactant and stir to dissolve.

EXAMPLE 2

A concentrate suitable for use upon dilution with water as a conveyor track lubricant was formulated in the following manner from the components set out in the Table below.

TABLE 2

Example Formulation

| Raw Material | % wt/wt Bulk raw material | % wt/wt active raw material |
|---|---|---|
| Soft Water | 88.5 | 88.5 |
| Acetic Acid | 2.5 | 2.5 |
| 1-amino ethyl 2 alkyl imidazoline | 4 | 2.6 |
| Akypo R090 | 3 | 2.7 |
| Lakeland AMA | 2 | 0.6 |

A typical manufacturing process for the formulation is as follows:

(1) Charge a mixing vessel with the required water.
(2) Add the acid and stir to disperse.
(3) Add the imidazoline and stir to disperse.
(4) Add the Akypo RO90 and stir to disperse.
(5) Add the Lakeland AMA and stir to disperse.

Variation of the order of steps in the manufacturing process is possible. For example, where the water is added first of all, production of linear by-products of the imidazolines appears to be increased. Where water is added last, the formation of linear by-products appears to be minimized.

Some or all of the cyclic imidazoline of general formula I or II can be replaced by the linear amide of general formula III or IV.

Although preferred embodiments of the invention are described herein in detail, it will be understood by those skilled in the art that variations may be made thereto without departing from the spirit of the invention or the scope of the appended claims.

We claim:

1. A concentrate comprising an aqueous carrier, the concentrate, upon dilution with additional water forming a lubricant for use on a conveyor track, which concentrate comprises the following components:

(a) (i) a cyclic imidazoline of the general formula (I):

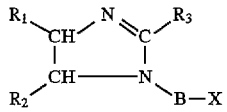

(I)

(a) (ii) an cyclic imidazoline of the general formula (II):

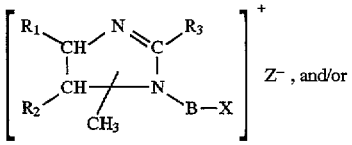

(II)

(a) (iii) an amide of the general formula (III) or (IV):

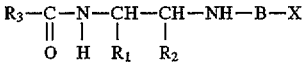

(III)

or

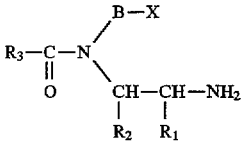

(IV)

wherein $R_1$, $R_2$, and $R_3$ are the same or different and are each —H or —A —Y, in which A is a $C_7$ to $C_{20}$ saturated or unsaturated, linear or branched chain alkylene group, B is a $C_1$ to $C_{20}$ saturated or unsaturated, linear or branched chain alkylene group, Y is H, $NH_2$, OH, or $COOM_1$ in which $M_1$ is H or a Group 1 metal ion, and X is H, $NH_2$, OH, $COOM_2$ or —NH—CO—$R_4$, in which $M_2$ is the same or different from $M_1$ and is H or a Group 1 metal ion and $R_4$ is a $C_1$ to $C_{20}$ saturated or unsaturated, linear or branched chain alkyl group and, in the cyclic imidazoline of general formula (II), the $CH_3$ ring substituent is present at position 1 or 3 of the ring, and $Z^-$ is an anion; and (b) an amount of acid sufficient to render the cyclic imidazoline or amide soluble in water, said acid (b) an amount of a carboxylic acid having up to 6 carbon atoms.

2. A concentrate according to claim 1, wherein component (b) is provided with one or more of components (a) (i) (a) (ii), (a) (iii) or (a) (iv) in the form of a salt.

3. A concentrate according to claim 1 or claim 2, wherein at least one of $R_1$, $R_2$, $R_3$, and B includes a saturated or unsaturated linear alkylene group of at least 12 carbon atoms or a branched chain alkylene group of at least 20 carbon atoms and $R_4$ is a $C_1$ to $C_{20}$ saturated or unsaturated linear or branched chain alkyl group.

4. A concentrate according to claim 3, wherein group A has from 12 to 18 carbon atoms.

5. A concentrate according to claim 1, wherein group B has from one to six carbon atoms.

6. A concentrate according to claim 1, wherein group X is $NH_2$.

7. A concentrate according to claim 6, wherein $R_1$ and $R_2$ are H, and $R^3$ is AY in which A has 17 carbon atoms and Y is H.

8. A concentrate according to claim 1, which comprises the cyclic imidazoline of general formula (II) in which group B has 2 carbon atoms and group X is —NH—CO—$R_4$.

9. A concentrate according to claim 1, wherein the organic acid is acetic acid.

10. A concentrate according to claim 1, which has a pH in the range 3 to 8.

11. A concentrate according to claim 1, which further comprises a (c) component selected from the group consisting of (c) (i) a non-ionic surfactant;

(ii) an ether carboxylate of general formula (V):

$$R_5—(OC_2H_4)_nOCH_2COOH \quad (V)$$

in which $R_5$ is $CH_3—(CH_2)_m^-$, where m is 0 or an integer from 1 to 20, or a $C_2$ to $C_{20}$ unsaturated carbon chain; or a saturated or unsaturated branched chain; and n is an integer from 1 to 30, (iii) an alkylamine carboxylate of general formula (VI):

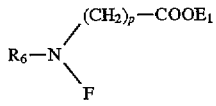

(VI)

in which $R_6$ is a $C_8$ to $C_{20}$ saturated or unsaturated, linear or branched chain alkyl group, $E_1$ is a hydrogen ion or a Group 1 metal ion and F is hydrogen or $—(CH_2)_q—COOE_2$ in which $E_2$ is a hydrogen ion or a Group 1 metal ion and is the same as or different from $E_1$; and p and q are the same or different and are integers from 1 to 12.

12. A concentrate according to claim 11, wherein the components (c) (i), (ii) and (iii) comprise:

(c) (i) a linear terminated ethoxylate;

(ii) the ether carboxylate of general formula (V), in which $R_5$ is an oleyl group and n=9; and (iii) the alkylamine carboxylate of general formula (VI), in which $R_6$ is a Coco group and F is $—(CH_2)_q—COOE_2$, in which p=q=2, E is a sodium ion and $E_2$ is a hydrogen ion.

13. A concentrate according to claim 1, which further comprises a viscosity controlling agent.

14. A concentrate according to claim 1, wherein components (a) (i) through (iii) in the concentrate are in the range 0.5 to 30 weight %.

15. A concentrate according to claim 1, wherein the concentrate has a pH in the range of 3 to 6.

16. A lubricant composition comprising a concentrate according to claim 1, diluted in water in the range 0.02 to 80% (volume/volume).

17. An aqueous lubricant composition for use as a lubricant on a conveyor track, the method including diluting a concentrate with water and applying the diluted concentrate to the conveyor track, the concentrate being an aqueous composition comprising:

(a) an active agent selected from the group consisting of (i) a cyclic imidazoline of the general formula (I):

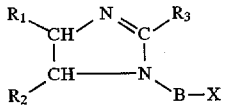

(I)

(ii) a cyclic imidazoline of the general formula (II):

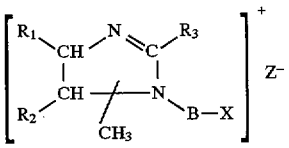

(II)

(ii) on amide of the general formula (III):

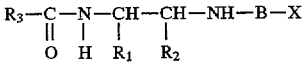

(III)

(iv) an amide of the general formula (IV):

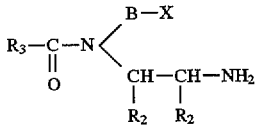

(IV)

and mixtures thereof, wherein $R_1$, $R_2$, and $R_3$ are the same or different and are each —H or —A —Y, in which A is a $C_7$ to $C_{20}$ saturated or unsaturated, linear or branched chain alkylene group, B is a $C_1$ to $C_{20}$ saturated or unsaturated, linear or branched chain alkylene group, Y is H, $NH_2$, OH, or $COOM_1$ in which $M_1$ is H or a Group 1 metal ion, and X is H, $NH_2$, OH, $COOM_2$ or —NH—CO—$R_4$, in which $M_2$ is the same or different from $M_1$ and is H or a Group 1 metal ion and $R_4$ is a $C_1$ to $C_{20}$ saturated or unsaturated, linear or branched chain alkyl group and, in the cyclic imidazoline of general formula (II), the $CH_3$ ring substituent is present at position 1 or 3 of the ring, and $Z^-$ is any suitable anion; and (b) an amount of a carboxylic acid having up to 6 carbon atoms.

18. The composition according to claim 17 wherein the carboxylic acid is acetic acid.

19. The composition according to claim 17 further comprising a surfactant present in an effective amount to reduce foam and improve soil handling properties.

* * * * *